US008418324B2

(12) United States Patent
Ito

(10) Patent No.: US 8,418,324 B2
(45) Date of Patent: Apr. 16, 2013

(54) TONGUE AND METHOD OF MANUFACTURING THE SAME

(75) Inventor: Tadao Ito, Iwata (JP)

(73) Assignee: Enshu Co., Ltd., Iwata-Shi (JP)

( * ) Notice: Subject to any disclaimer, the term of this patent is extended or adjusted under 35 U.S.C. 154(b) by 475 days.

(21) Appl. No.: 12/665,895

(22) PCT Filed: Sep. 7, 2007

(86) PCT No.: PCT/JP2007/067513

§ 371 (c)(1),
(2), (4) Date: Dec. 21, 2009

(87) PCT Pub. No.: WO2009/001482

PCT Pub. Date: Dec. 31, 2008

(65) Prior Publication Data

US 2010/0180409 A1 Jul. 22, 2010

(30) Foreign Application Priority Data

Jun. 26, 2007 (JP) ..... 2007-167431

(51) Int. Cl.
*A44B 11/25* (2006.01)

(52) U.S. Cl.
USPC ..... 24/198

(58) Field of Classification Search ..... 24/163 R, 24/198, 200; 280/801.1, 801.2, 808; 72/46, 72/53; 29/527.4
See application file for complete search history.

(56) References Cited

U.S. PATENT DOCUMENTS

| | | | | |
|---|---|---|---|---|
| 3,696,471 | A * | 10/1972 | Mermelstein | 24/193 |
| 6,195,849 | B1 * | 3/2001 | Smith et al. | 24/198 |
| 2001/0014997 | A1 | 8/2001 | Suzuki et al. | |
| 2003/0106192 | A1 * | 6/2003 | Schmitz | 24/614 |
| 2003/0234530 | A1 * | 12/2003 | Moskalik et al. | 280/801.1 |
| 2006/0138852 | A1 | 6/2006 | Ichida | |

FOREIGN PATENT DOCUMENTS

| | | | |
|---|---|---|---|
| JP | 54-033823 | | 3/1979 |
| JP | 03-200192 | A | 9/1991 |
| JP | 09-290706 | A | 11/1997 |
| JP | 10-063763 | A | 3/1998 |
| JP | 2000-176664 | A | 6/2000 |
| JP | 2002-096712 | A | 4/2002 |
| JP | 3440063 | B2 | 8/2003 |
| JP | 2006-182103 | A | 7/2006 |
| WO | WO2006/132129 | A1 | 12/2006 |

* cited by examiner

*Primary Examiner* — James Brittain
(74) *Attorney, Agent, or Firm* — Marvin A. Motsenbocker; Mots Law, PLLC

(57) ABSTRACT

In a tongue used in a seat belt system, a tongue main body 25 including a belt insertion hole 23 in which to insert a seat belt 3 is provided with an insertion part 27 in a projecting manner. The insertion part 27 is capable of being inserted in a buckle in the seat belt system, and includes a lock hole 27*a* to which a lock piece included in the buckle is capable of being locked. A front surface of the insertion part 27 is formed into a concave and convex surface by being provided with multiple convex parts 29 or multiple concave parts. The convex parts 29 or the concave parts included in a rear surface of the tongue are formed corresponding to the convex parts 29 or the concave parts included in the front surface. A height of each convex part 29 from a reference position or a depth of each concave part from the reference position is 0.01 mm to 0.10 mm.

9 Claims, 8 Drawing Sheets

TONGUE AND METHOD OF MANUFACTURING THE SAME

TECHNICAL FIELD

The present invention relates to a tongue used in a seat belt system for an automobile. More specifically, the present invention relates to a tongue and a method of manufacturing the same, the tongue having a structure including a tongue main body including a seat belt insertion hole in which to insert a seat belt; and an insertion part which projects on the tongue main body, and which is designed to be inserted in a buckle in a seat belt system, in which the surfaces of the insertion part are formed into concave and convex surfaces by being provided with multiple convex parts or concave parts.

BACKGROUND ART

As shown in FIG. 1(*a*), a tongue 1 used in a seat belt system for an automobile is used by being attached to a seat belt (woven belt) 3 in the seat belt system. While in use, the tongue 1 is connected to a buckle 7 attached to an end portion of a fixed belt 5 in the seal belt system. As shown in FIG. 1(*b*), a general structure of the tongue 1 is that: an insertion part 13 to be inserted in the buckle 7 is integrally provided in a projecting manner on a tongue main body 11 including a seat belt insertion hole 9 in which to insert the seat belt 3; and a lock hole 13*a*, to which a lock piece (not illustrated) included in the buckle 7 is capable of being locked, is provided in the neighborhood of a front end portion of this insertion part 13.

In addition, the general structure of the tongue 1 is that, as shown in FIG. 1(*b*), the surfaces of an area surrounding the seat belt insertion hole 9 included in the tongue main body 11 are covered with a molded resin 15. Moreover, as shown in FIG. 1(*c*), a tongue has been developed which has a structure in which a curved part 17 whose cross-section is shaped almost like a letter J is formed in a part of the belt insertion hole 19 instead of using the molded resin. Such a technique has been disclosed, for instance, in Japanese Patent Official Gazette: Japanese Patent No. 3440063 (Patent Document 1).

The tongue 1 of the above-described type is obtained as follows. First of all, a tongue material is produced by applying a punching process and a forming process to a metal plate by use of a pressing machine. Subsequently, as a surface treatment, a plating process is applied to the tongue material. Thereafter, the tongue material is covered with a molded resin. In a pressing process using a pressing machine, very small scraps, which are produced during the pressing process, and the like sometimes fall on the metal plate, so that very small bruises, although having no influence on the strength of the tongue itself, are caused in the surfaces of the tongue 1. Furthermore, while tongues 1 are transferred to an ensuing step in the manufacturing process, scratches, scratched marks and the like are sometimes caused in the surfaces of the tongues 1 as a result of mutual contacts between the tongues 1.

Very small bruises, scratches and the like having no influence on a tongue 1 do not matter as long as they are in an area covered with the molded resin 15 and thus look less conspicuous. On the contrary, if very small bruises, scratches and the like of the above-described type are found in any one surface of the insertion part 13 of the tongue 1 in the final stage after the molded resin 15 is molded, such a tongue 1 is discarded as a defective product. That is because: the scratches and the like look more conspicuous against the surface of the insertion part 13 which is solid and glazed; and the conspicuousness deteriorates the aesthetic appearance quality. The discard rate of tongues is approximately several percent to ten percent. This causes a problem of low yields. For this reason, the enhancement of the yields has been awaited for. In addition, it has been demanded that the bonding strength (connecting strength) between the tongue main body and the molded resin should be further increased in accordance with the material of the molded resin.

The present invention has been made for the purpose of solving the above-described problems. A first object of the present invention is to provide a tongue and a method of manufacturing the same, the tongue being capable of improving the aesthetic appearance quality by preventing scratches or the like from being caused in any one surface of the insertion part of the tongue.

A second object of the present invention is to provide a tongue and a method of manufacturing the same, the tongue being capable of improving a bonding strength (connecting strength) with the molded resin by increasing its surface area with multiple convex parts or concave parts.

DISCLOSURE OF THE INVENTION

In order to achieve the first and second objects, a first aspect of the present invention is a tongue used in a seat belt system including: a tongue main body including a belt insertion hole in which to insert a seat belt; an insertion part being capable of being inserted in a buckle in the seat belt system, including a lock hole to which a lock piece included in the buckle is capable of being locked, and projecting from the tongue main body; and multiple convex parts or multiple concave parts being included in a front surface of the insertion part, the front surface of the insertion part being formed into a concave and convex surface by the structure.

A second aspect of the present invention is a tongue used in a seat belt system including: a tongue main body including a belt insertion hole in which to insert a seat belt; an insertion part being capable of being inserted in a buckle in the seat belt system, including a lock hole to which a lock piece included in the buckle is capable of being locked, and projecting from the tongue main body; and multiple convex parts or multiple concave parts being included in a front surface of the tongue main body, the front surface of the tongue main body being formed into a concave and convex surface by the structure.

A third aspect of the present invention is a tongue used in a seat belt system including: a tongue main body including a belt insertion hole in which to insert a seat belt; an insertion part being capable of being inserted in a buckle in the seat belt system, including a lock hole to which a lock piece included in the buckle is capable of being locked, and projecting from the tongue main body; and multiple convex parts or multiple concave parts being included in a front surface of the insertion part and a front surface of the tongue main body, the front surface of the insertion part and the front surface of the tongue main body being each formed into a concave and convex surface by the structure.

A fourth aspect of the present invention dependent on any one of the first to third aspects is, in the tongue used in the seat belt system, the convex parts or the concave parts included in a rear surface of the tongue are formed corresponding to the convex parts or the concave parts included in the front surface.

A fifth aspect of the present invention dependent on any one of the first to fourth aspects is, in the tongue used in the seat belt system, a height of each convex part from a reference position or a depth of each concave part from the reference position is 0.01 mm to 0.10 mm.

A sixth aspect of the present invention is a method of manufacturing a tongue which is used in a seat belt system, the method including the steps of: forming a shape in which an insertion part capable of being inserted in a buckle in the seat belt system is provided in a projecting manner on a tongue main body including a seat belt insertion hole in which to insert a seat belt; performing a coining process in order to form a front surface of the insertion part into a concave and convex surface provided with multiple concave parts or multiple convex parts; applying a plating process on the tongue main body and the insertion part; and covering an area surrounding the seat belt insertion hole of the tongue main body with a resin.

A seventh aspect of the present invention is a method of manufacturing a tongue which is used in a seat belt system, the method including the steps of: forming a shape in which an insertion part capable of being inserted in a buckle in the seat belt system is provided in a projecting manner on a tongue main body including a seat belt insertion hole in which to insert a seat belt; performing a coining process in order to form a front surface of the tongue main body into a concave and convex surface provided with multiple concave parts or multiple convex parts; applying a plating process on the tongue main body and the insertion part; and covering an area surrounding the seat belt insertion hole of the tongue main body with a resin.

An eighth aspect of the present invention is a method of manufacturing a tongue which is used in a seat belt system, the method including the steps of forming a shape in which an insertion part capable of being inserted in a buckle in the seat belt system is provided in a projecting manner on a tongue main body including a seat belt insertion hole in which to insert a seat belt; performing a coining process in order to form a front surface of each of the tongue main body and the insertion part into a concave and convex surface provided with multiple concave parts or multiple convex parts; applying a plating process on the tongue main body and the insertion part; and covering an area surrounding the seat belt insertion hole of the tongue main body with a resin.

The first to eighth aspects of the present invention makes it possible to enhance the aesthetic appearance quality of the tongue by preventing scratches or the like from being caused in any one surface of the insertion part of the tongue. In addition, the first to eighth aspects of the present invention makes it possible to increase the bonding strength (connecting strength) with the molded resin by increasing the surface area with the multiple convex parts or concave parts.

BEST MODES FOR CARRYING OUT THE INVENTION

Descriptions will be hereinbelow provided for best modes for the present invention on the basis of FIGS. 2 to 11.

Figure 2:
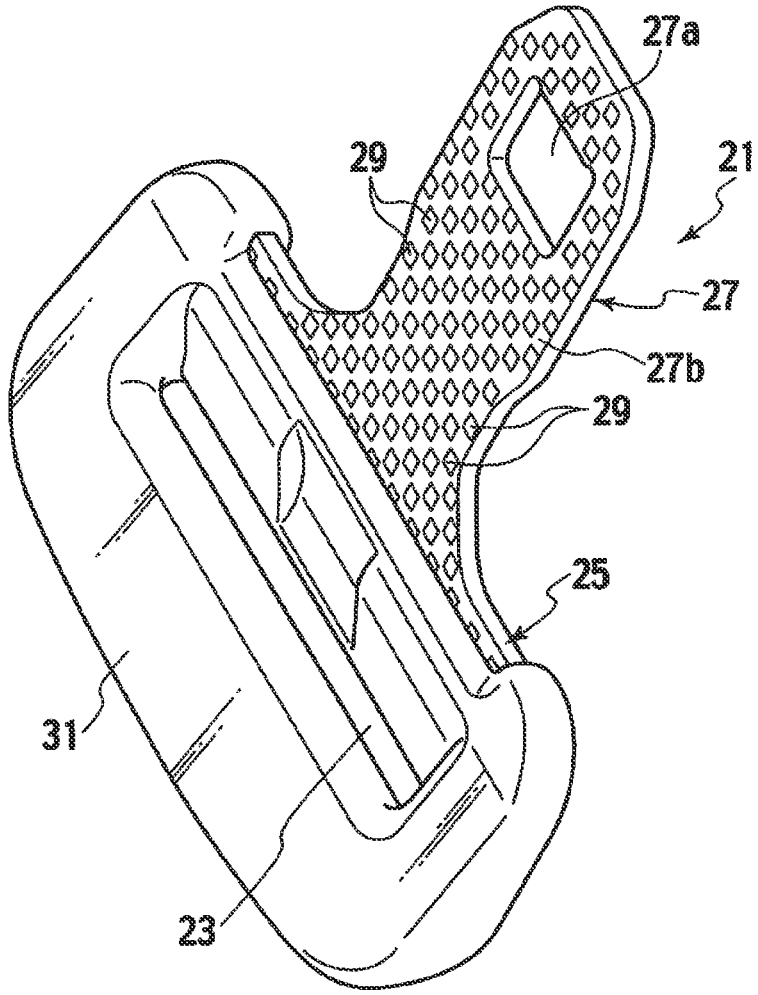
FIG. 2 is an explanatory diagram showing how a tongue according to an embodiment of the present invention is structured.

As shown in FIG. 2, a tongue 21 according to an embodiment of the present invention includes a tongue main body 25, which has a seat belt insertion hole 23 in which to insert a seat belt (not illustrated) in a seat belt system, as the above-described conventional tongue does. An insertion part 27 to be inserted in a buckle (not illustrated) in the seat belt system is provided in a projecting manner on this tongue main body 25 integrally.

A lock hole 27*a*, to which a lock piece included in the buckle is capable of being locked, is formed in the neighborhood of a front end portion of the insertion part 27. In addition, an area surrounding the seat belt insertion hole 23 formed in the tongue main body 25 is covered with a molded resin 31 as in the case of the conventional tongue.

Multiple convex parts 29 are formed over both the front and rear surfaces of each of the tongue main body 25 and the insertion part 27 in the tongue 21 at appropriate intervals. In other words, both the entire front and rear surfaces thereof are formed into concave and convex surfaces by the provision of the convex parts 29. The convex parts 29 are formed by a coining process during a step of applying a pressing process to the tongue 21. The convex portions 29 may be those which project in a way to be embossed on a plane part 27*b* of each of the front and rear surfaces of the insertion part 27.

Figure 1:
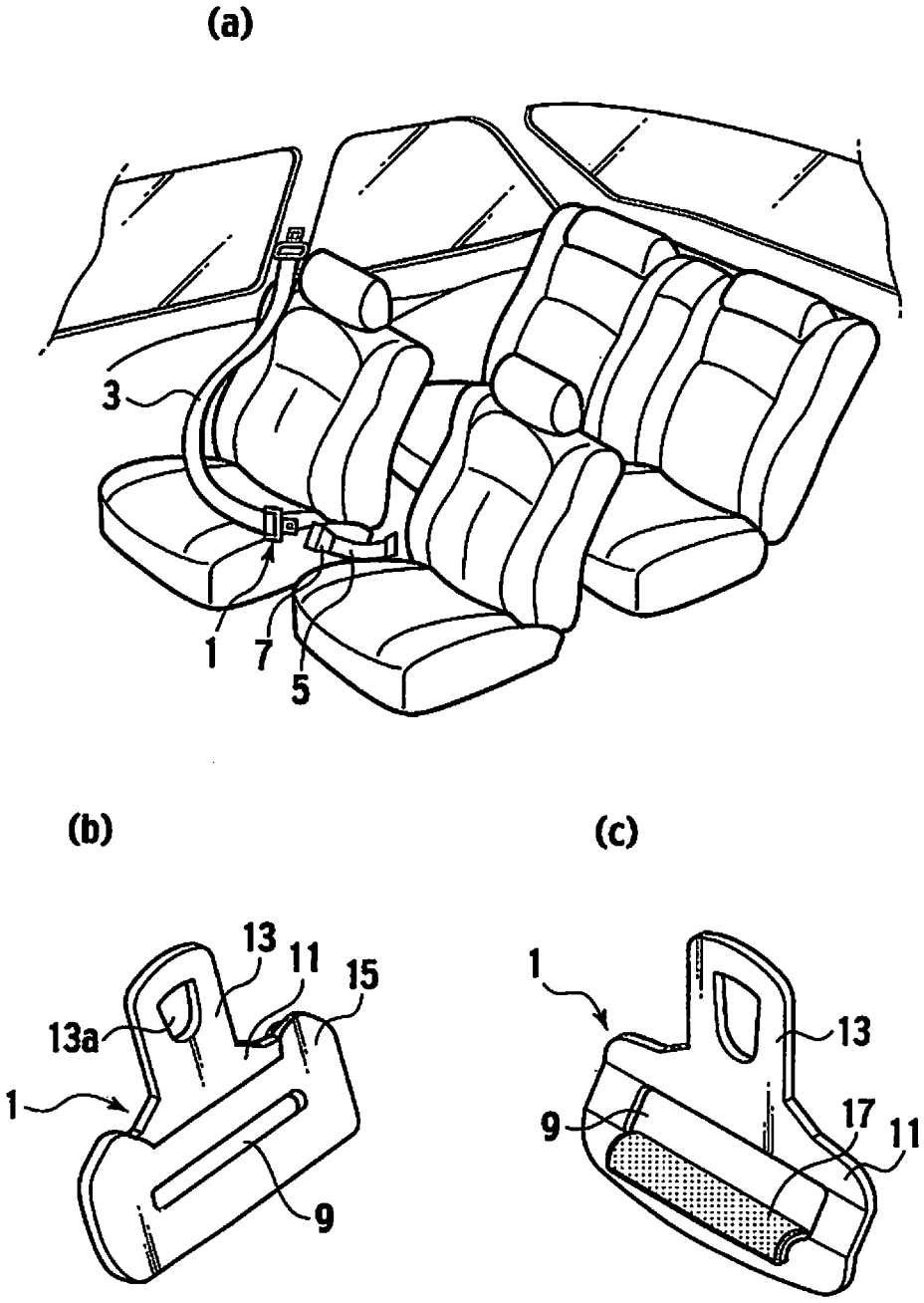
FIG. 1 Prior Art
FIGS. 1(*a*), 1(*b*) and 1(*c*) are explanatory diagrams showing an example of how to use a conventional tongue and how the conventional tongue is structured.

Note that the convex parts 29 slightly project from the plane part 27*b*, although FIG. 1 illustrates the convex parts 29 as if they were flat. The convex parts 29 may be formed into any shape. The convex parts 29 may be randomly distributed at appropriate intervals, or may be arranged to have an appropriate pattern. Otherwise, the convex parts 29 may be formed into stripes of an appropriate length which are connected to one another. It is desirable that the top portion of each convex part 29 should be shaped like a flat surface or an outward curved surface.

Instead of the convex parts 29, concave parts may be formed in locations of the convex parts 29, respectively, as the structure in which both the front and rear surfaces of the tongue 21 are formed into the concave and convex surfaces. In other words, the structure of the concave and convex surface may be any one of the structure in which the convex parts 29 are formed on the plane part, the structure in which the concave parts are formed in the plane part, and a structure in which the convex parts 29 and the concave parts are formed in the plane part. An important point is that each concave and convex surface should not be a smooth surface.

As described above, the tongue main body 25 of the tongue 21 has the concave and convex surfaces formed by being provided with the convex parts 29. This increases the surface area of the tongue main body 25, and thus enhances the bonding (joining, adhering) strength between the tongue main body 25 and the molded resin 31 when the area surrounding the seat belt insertion hole 23 included in the tongue main body 25 is covered with the molded resin 31.

In addition, each concave and convex surface having the convex parts 29 is formed by the coining process. For this reason, even when there are very small bruises, scratches and the like in the tongue main body 25 and the insertion part 27 in a step preceding the step of forming the convex parts 29, it is possible to erase them so as to make them inconspicuous through the coining process. In addition, because the concave and convex surfaces each having the convex parts 29 are formed in the insertion part 27 of the tongue 21, it is possible to inhibit another tongue and the like from contacting or abutting on any plane part 27*b* of the insertion part 27. This makes it possible to inhibit scratches and the like from occurring in each plane part 27*b*.

Furthermore, even in a case where tongues 21 come in contact with each other and cause scratch marks or the like therein, the marks are caused in top portions of some convex parts 29, and have no influence on the strength of the tongue 21. In addition, the length of each mark is so short that the mark cannot be recognized. This makes it possible to enhance the aesthetic appearance quality of each tongue.

The shapes of, and the intervals between, the convex parts 29 formed in the tongue main body 25 and the insertion part 27 of the tongue 21 may be equal to, or different from, one another. For instance, the shapes of, and the intervals between, the convex parts 29 in the tongue main body 25 are determined by giving consideration to how a resin flows when the molded resin 31 is molded, and to the performance of intimate contact (joining, bonding) between the tongue main body 25 and the molded resin 31. Furthermore, it is desirable that the shapes of, and the intervals between, the convex parts 29 in the insertion part 27 should be determined by giving consideration to the inhibition of scratches caused by the insertion part 27 being brought into contact with the buckle in its repeated insertion to and detachment from the buckle.

In the present embodiment, the intervals at which the convex parts 29 are arranged are set smaller than the plate thickness dimension of each tongue 21 in order that, when the tongue 21 and a different tongue 21 interfere with each other, no plane part of the tongue 21 should be directly brought into contact with the different tongue 21. For this reason, even in a case where tongues 21 abut on or contact each other, it is possible to inhibit one tongue 21 from abutting on or contacting either plane part of the tongue main body 25 or either plane part 27*b* of the insertion part 27 in the other tongue 21. This makes it possible to prevent very small scratches and the like from being caused in any plane part.

Further, when both of the front and rear surfaces of each of the tongue main body 25 and the insertion part 27 are formed into the concave and convex surface by employing a structure of causing the convex parts 29 to project from the plane parts thereof, the projecting height of each convex part 29 is set in a range of 0.01 mm to 0.1 mm above the corresponding plane part which is the reference position. When a structure of including concave parts is employed, the depth of each concave part is set in a range of 0.01 mm to 0.1 mm under the corresponding plane part which is the reference position. When a structure of including convex parts 29 and concave parts is employed, the dimensional difference of elevation between the top portion of each convex part 29 and the bottom portion of each concave part is set in a range of 0.01 mm to 0.1 mm.

Figure 3:
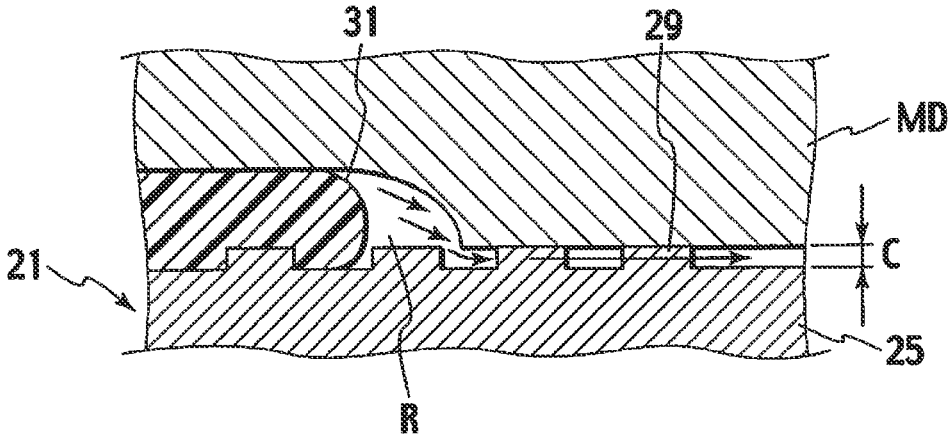
FIG. 3 is a partial magnified cross-sectional explanatory diagram for explaining a clearance between a die and a tongue material.
Figure 4:
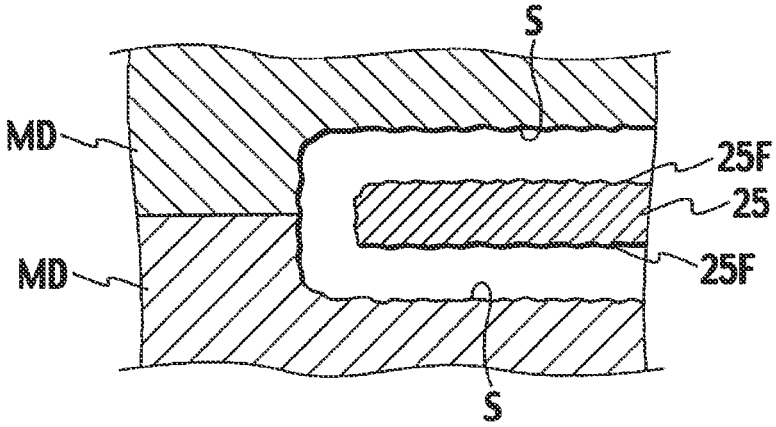
FIG. 4 is an explanatory diagram of the crimped surfaces of the respective dies and the corresponding crimped surfaces of the tongue material.
Figure 5:
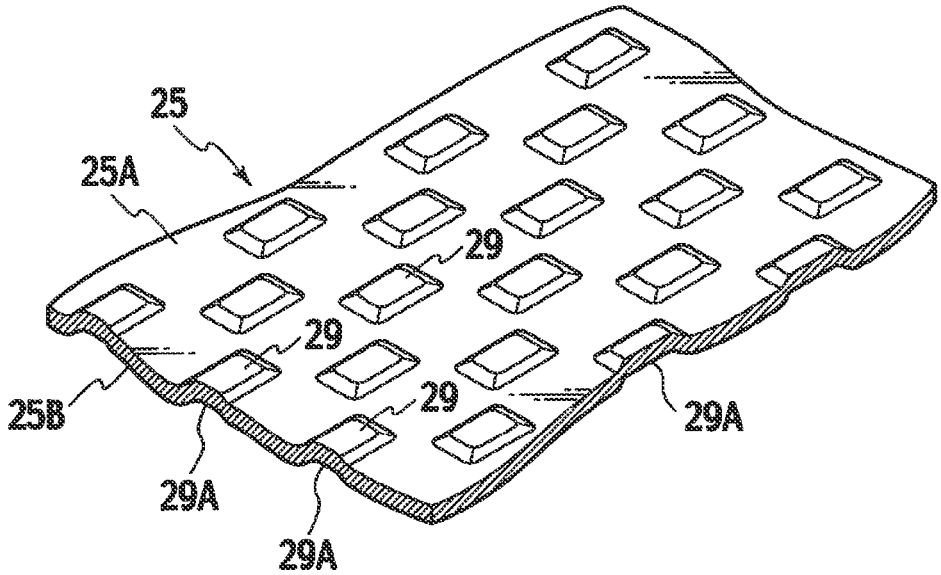
FIG. 5 is an explanatory diagram showing an example of a form of a concave and convex surface.

To be more specific, when the tongue main body 25 of the tongue 21 is covered with the molded resin 31 by molding with the tongue main body 25 being inserted and set between molding dies MD as shown in a partial schematic magnified cross-sectional view of FIG. 3, a clearance C corresponding to the projecting height of each convex part 29, the depth of each concave part, and the like is generated between each molding die MD and the corresponding plane part of the tongue main body 25.

The molded resin 31 flows into a space R, which is formed by each molding die MD and the tongue main body 25, as indicated by arrows extending from the left to the right in FIG. 3. In this case, the above-described flow of the molded resin 31 causes a gas (air) present in the space R to go ahead of the molded resin 31 in a direction indicated by the arrows, and subsequently to move in a zigzag manner among the convex parts 29 in the direction indicated by the arrows. In this way, the gas (air) flows out via the clearance C between the molding die MD and the tongue main body 25 in the rightward direction in FIG. 3.

While the molded resin 31 is advancing in the direction indicated by the arrows, if the clearance C is too large, flashes are sometimes formed in the following manner: the molded resin 31 advances beyond the space R; the molded resin 31 leaks out of the space R, thus flowing into the clearance C. For this reason, it is desirable that the projecting height of each convex part 29, the depth of each concave part, and the like should be not more than 0.10 mm.

If the projecting height of each convex part 29, the depth of each concave part, and the like are not more than 0.01 mm, the gap (clearance) dimension between each molding die MD and the corresponding plane part of the tongue main body 25 is reduced. This deteriorates the escapability (flow-out performance) of the gas flowing out of the die when the molded resin 31 is filled in the molding die MD. For this reason, the too small projecting height of the convex part 29, the too small depth of the concave part, and the like are undesirable from a viewpoint of enhancing the productivity and the molding quality of the molded resin 31.

It is more desirable that the concave and convex surface should be formed in a way that the clearance C between each molding die MD and the corresponding plane part of the tongue main body 25 is in a range of 0.03 mm to 0.08 mm. When the clearance C is set in the above-mentioned range, it is possible to inhibit the flashes mentioned above from being formed, and concurrently to enhance the flow-out performance of the gas flowing out of the die. This makes it possible to enhance the productivity easily.

Meanwhile, the tongue 21 is beforehand subjected to a plating process when the tongue main body 25 of the tongue 21 is covered with the molded resin 31. For this reason, the tongue main body 25 has a glazed smooth surface in a state where no convex parts 29 or the like are formed (with a structure in which a solid surface is employed as in the case of the conventional usual tongue). In addition, as shown in the partial schematic magnified cross-sectional view of FIG. 4, a surface of a part of each molding die MD into which the molded resin 31 is filled is usually formed as a crimped surface S in which very small convex and concave portions are formed.

For this reason, when molding is performed in order to cover a tongue main body of a conventional usual tongue with a molded resin, the molded resin tends to slip on each surface of the tongue main body of the conventional tongue, and the crimped surface S of each molding die MD works as a resistance against the flow of the molded resin 31. In other words, the flow of part of the resin 31 which contacts any one surface of the tongue main body of the conventional tongue and the flow of part of the resin 31 which contacts the crimped surface S of the corresponding molding die MD go out of balance. This is problematic from a viewpoint of enhancing the aesthetic appearance quality of the molded resin.

On the contrary, in the case of the present embodiment, the concave and convex surfaces each including the convex parts 29 and/or the like which are arranged at appropriate intervals are formed in the tongue main body 25 of the tongue 21. For this reason, when molding is performed in order to cover the part of the tongue main body 25 with the molded resin 31, each concave and convex surface provided to the tongue main body 25 works as a resistance against the flow of the molded resin. Accordingly, when the molded resin 31 is filled between the molding dies MD with the tongue main body 25 being inserted and set therebetween, it is possible to make almost equal the flow of part of the molded resin which contacts any one surface of the tongue main body 25 and the flow of part of the molded resin 31 which contacts the crimped surface S of the corresponding molding die MD. This makes it possible to inhibit the unbalance in the flow of the molded resin, and thus to solve the conventional problem described above.

As already understood, the formation of the concave and convex surface including the convex parts 29 and/or the like on both the entire front and rear surfaces of each of the tongue main body 25 and the insertion part 27 of the tongue 21 makes it possible to enhance the aesthetic appearance quality of the tongue 21, and concurrently to enhance the quality with which the molded resin 31 is molded. In addition, as another structure for making equal the flow of part of the molded resin which contacts the crimped surface of any one molding die MD and the flow of part of the molded resin 31 which contacts the corresponding surface of the tongue main body 25 of the tongue 21, as shown FIG. 4, each surface of the tongue main body 25 may be formed into a concave and convex surface 25F whose pattern is identical to that of the crimped surface S of the corresponding molding die MD.

Further, in the conventional tongue, for instance, a center portion of the insertion part is sometimes deformed slightly in a way to curve downward (or upward) in the middle portion in the width direction of the insertion part along the axis in the projecting direction of the insertion part due to the release of the tongue from a shearing resistance, an internal stress, and the like which occur when a blanking or piercing process is applied to the tongue during the pressing process. The insertion part is required to be flat with high precision, because the insertion part is a part configured to engage with the buckle in the seat belt system. For this reason, the above-mentioned curve is heretofore corrected in some cases.

On the contrary, in the present embodiment, the tongue 21 is formed to have the concave and convex surfaces provided with the convex parts 29 by being subject to the coining process. Thus, even if the curvature or the like occurs in the tongue 21, such curve is corrected by the coining process. Furthermore, once the multiple convex parts 29 are formed in the tongue main body 25 and the insertion part 27, the tongue becomes less likely to curve. For this reason, the tongue rarely curves again after the tongue is released from the coining die.

The tongue 21 is manufactured in almost the same manner as that of the conventional tongue. In other words, through the pressing process, the seat belt insertion hole 23 is punched out in part of a belt-shaped steel plate as a metal plate, which corresponds to the tongue main body 25, and concurrently a shape integrally including the tongue main body 25 and the insertion part 27 is punched out of the steel plate. In addition, necessary forming processes such as a trimming process are applied to an outline portion of the tongue main body 25, an outline portion of the insertion part 29, as well as outline portions respectively of the seat belt insertion hole 23 and the like as in the case of the manufacturing of the conventional tongue. Subsequently, before a plating process as a surface treatment is performed, the coining process is applied to the tongue 21 by use of a coining die. Thereby, the multiple convex portions 29 and/or the like are formed in both the front and rear surfaces of each of the tongue main body 25 and the insertion part 27, and both the front and rear surfaces thereof are thus formed into the concave and convex surfaces. Thereafter, as in the case of the conventional tongue, the molded resin 31 is molded in the area surrounding the seat belt insertion hole 23 of the tongue main body 25 with the tongue 21 being inserted and set between the molding dies.

In other words, the method of manufacturing the tongue 21 according to the present embodiment follows the method of manufacturing the convention tongue, and the two methods are almost identical to each other. The difference between the two methods is that the method of manufacturing the tongue 21 according to the present embodiment additionally includes the coining process of forming the concave and convex surface, which includes convex parts 29 and/or the like, on both the entire front and rear surfaces of the tongue 21 as a step preceding the surface treatment step such as the plating process.

Note that: the present invention is not limited to the foregoing embodiment; and the present invention can be carried out as another embodiment by modifying the present invention depending on the necessity. In other words, the entire surfaces of both the tongue main body 25 and the insertion part 27 are not necessarily formed into the concave and convex surface including the convex parts 29 and/or the like. The two surfaces of either the tongue main body 25 or the insertion part 27 may be formed into the concave and convex surface depending on the necessity. Alternatively, the concave and convex surface including the convex parts 29 and/or the like may have a structure of causing a convex part 29 which correspond to, for instance, a portion of wire lines defining holes of a wire net, to extend successively on the entire surface. In this case, one concave part is used. Furthermore, various designs can be applied to the insertion part 27 by providing convex parts 29 or concave parts to the insertion part 27. This enhances the aesthetic appearance quality.

Meanwhile, yet another structure may be selected as the structure in which both the front and rear surfaces of each of the tongue main body 25 and the insertion part 27 in the tongue 21 are formed into the concave and convex surfaces. In this structure, as shown by a magnified part of the tongue 25 of FIG. 5, convex parts 29 are formed on the front surface 25A of the tongue main body 25, whereas concave parts 29A, which correspond to the convex parts 29, are provided to the rear surface 25B of the tongue main body 25. In other words, the convex parts 29 may be structured in a way to project from the rear surface 25B to the front surface 25A of the tongue main body 25. In the structure described above, the concave and convex surface as the front surface 25A is a concave and convex surface in the form obtained by projecting the convex parts 29 from a flat surface, whereas the concave and convex surface as the rear surface 25B is a concave and convex surface in the form obtained by providing the concave parts 29A to the flat surface. Even this structure for the concave and convex surface can bring about the foregoing effect.

Figure 6:
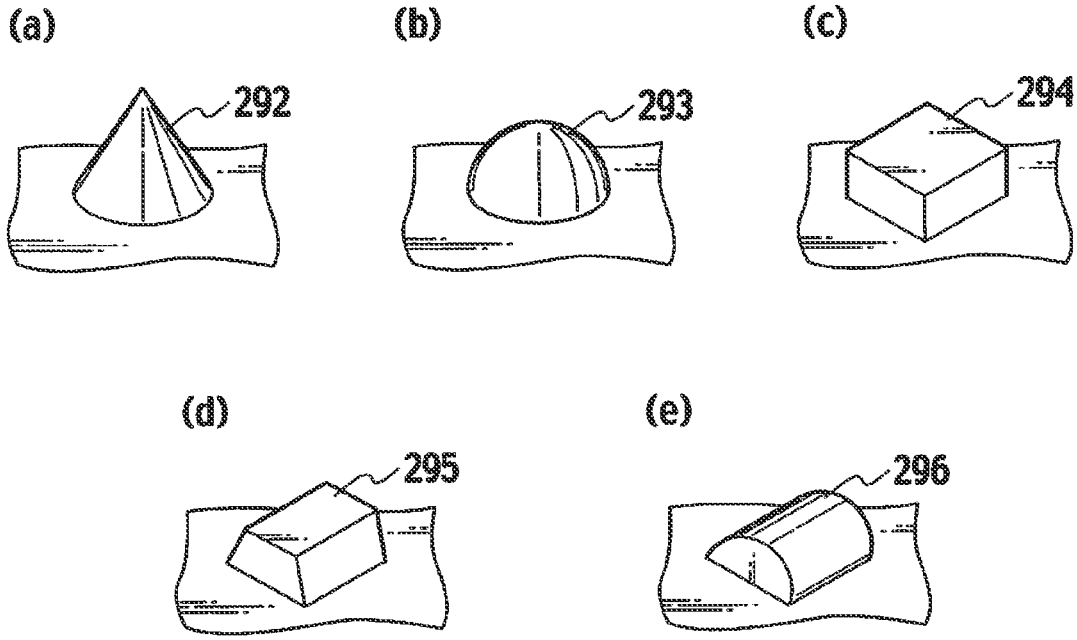
FIGS. 6(*a*), 6(*b*), 6(*c*), 6(*d*) and 6(*e*) are explanatory diagrams showing shapes of convex parts.

As emphatically shown in the following drawings, the shape of each convex part 29 may be any desired shape selected, for instance, from a cone 292 as shown in FIG. 6(*a*), a hemisphere 293 as shown in FIG. 6(*b*), a square pole 294 as shown in FIG. 6(*c*), a trapezoid 295 as shown in FIG. 6(*d*), and a dome (semi-cylindrical shape) 296 as shown in FIG. 6(*e*).

Similarly, in a case where the concave and convex surface is formed by including concave parts, the shape of the concave parts may be any desired shape selected from shapes corresponding to the shapes for the convex parts 29.

Figure 7:
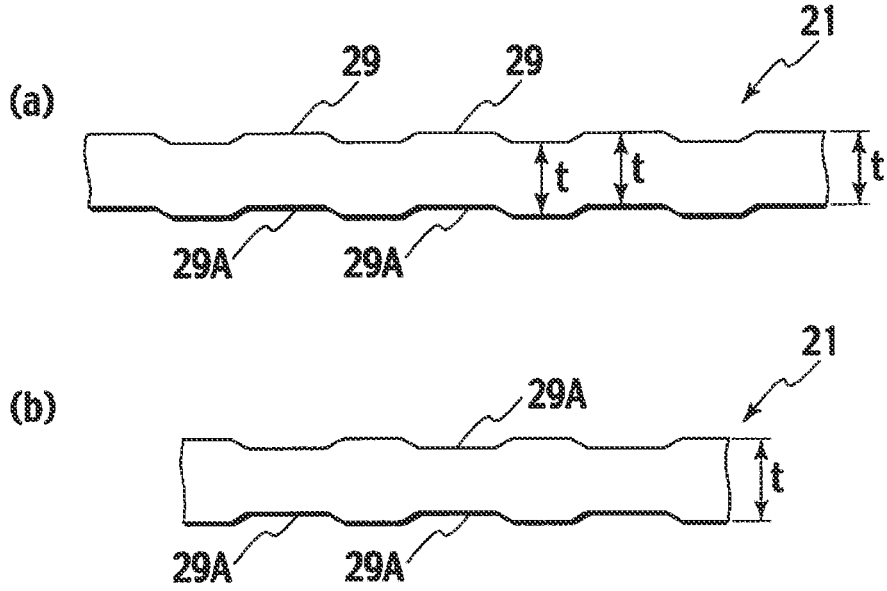
FIGS. 7(*a*) and 7(*b*) are cross-sectional explanatory diagrams showing shapes of concave and convex surfaces.

Furthermore, as a structure in which both the front and rear surfaces of the tongue 21 are formed into the concave and convex surfaces, the front and rear surfaces may be formed in a way that, as shown in FIG. 7(*a*), the locations where the convex parts 29 are formed on the front surface (top surface) coincide with the locations where the concave parts 29A are formed on the rear surface (undersurface), respectively. Otherwise, the front and rear surfaces may be formed in a way that, as shown in FIG. 7(*b*), the locations where the concave parts 29A are formed on the front surface coincide with the locations where the concave parts 29A are formed on the rear surface, respectively.

Figure 8:
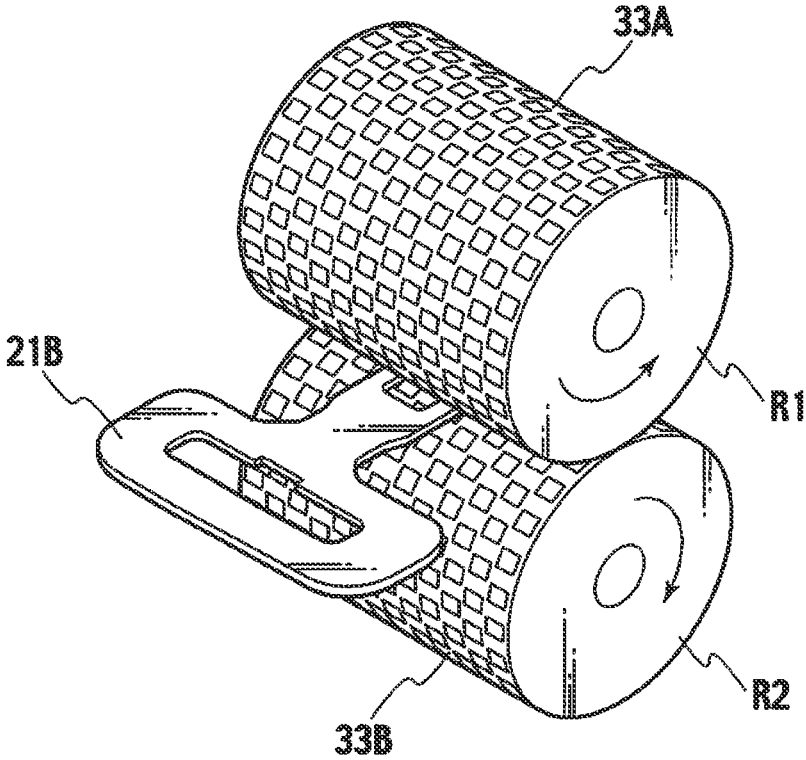
FIG. 8 is an explanatory diagram of an apparatus for forming concave and convex surfaces in a tongue material.

As conceptually and schematically shown in FIG. 8, the formation of both the front and rear surfaces of the tongue 21 into the concave and convex surface may be achieved by a configuration in which a tongue material 21B is inserted between transfer rolls R1, R2 that, in their circumferential surfaces, have concave and convex surfaces 33A, 33B each including convex parts or/and concave parts whose patterns are transferred to the tongue material 21B. This configuration makes it possible to transfer the patterns of the concave and convex surfaces 33A, 33B, which are formed in the circumferential surfaces of the paired transfer rolls R1, R2, to tongue materials 21B which are sequentially supplied between the paired transfer rolls R1, R2. For this reason, this configuration makes it possible to enhance the productivity.

Note that it is desirable that the foregoing configuration should include backup rolls configured to press the paired transfer rolls R1, R2 in the directions in which the paired transfer rolls R1, R2 come closer to each other, for the purpose of preventing the paired transfer rolls R1, R2 from going away from each other when the patterns of the concave and convex surfaces 33A, 33B of the transfer rolls R1, R2 are transferred to the tongue material 21B.

Figure 9:
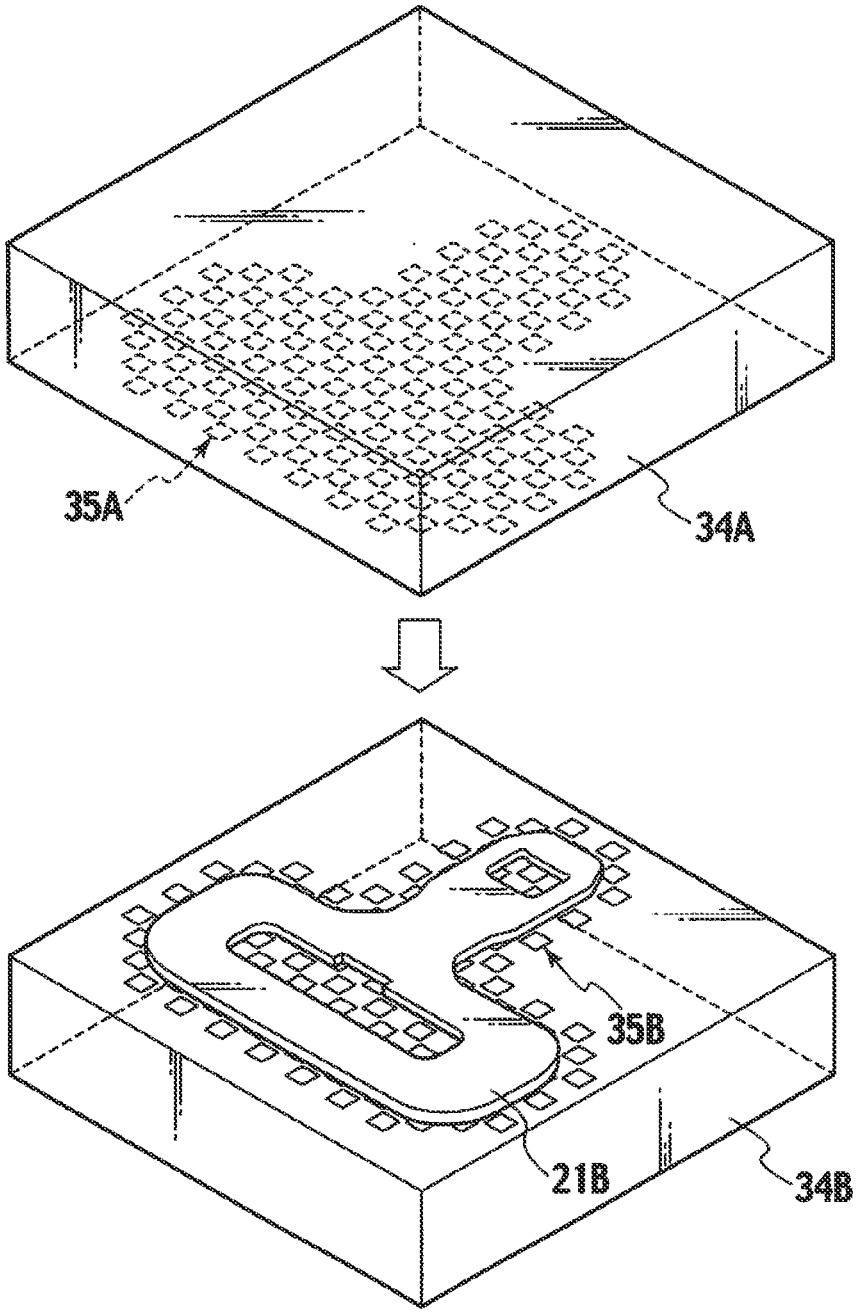
FIG. 9 is an explanatory diagram of another apparatus for forming concave and convex surfaces in a tongue material.

Otherwise, the formation of both the front and rear surfaces of the tongue 21 into the concave and convex surface may be achieved by a structure in which, as schematically and schematically shown in FIG. 9, the opposed surfaces of upper and lower dies 34A, 34B are provided with concave and convex surfaces 35A, 35B whose patterns are transferred to the tongue material 21B, respectively. Then, the tongue material 21B is positioned on the concave and convex surface 35B in the lower die 34B. Thereafter, the upper and lower dies 34A, 34B are operated by the pressing machine in a way that the upper and lower dies 34A, 34B come closer to each other relatively. Subsequently, the tongue material 21 is pressed by the concave and convex surfaces 35A, 35B of the upper and lower dies 34A, 34B, that is, the tongue material 21 is subject to the coining process. Thereby, the patterns of the concave and convex surfaces 35A, 35B of the upper and lower dies 34A, 34B can be transferred to both the front and rear surfaces of the tongue material 21B, respectively.

Figure 10:
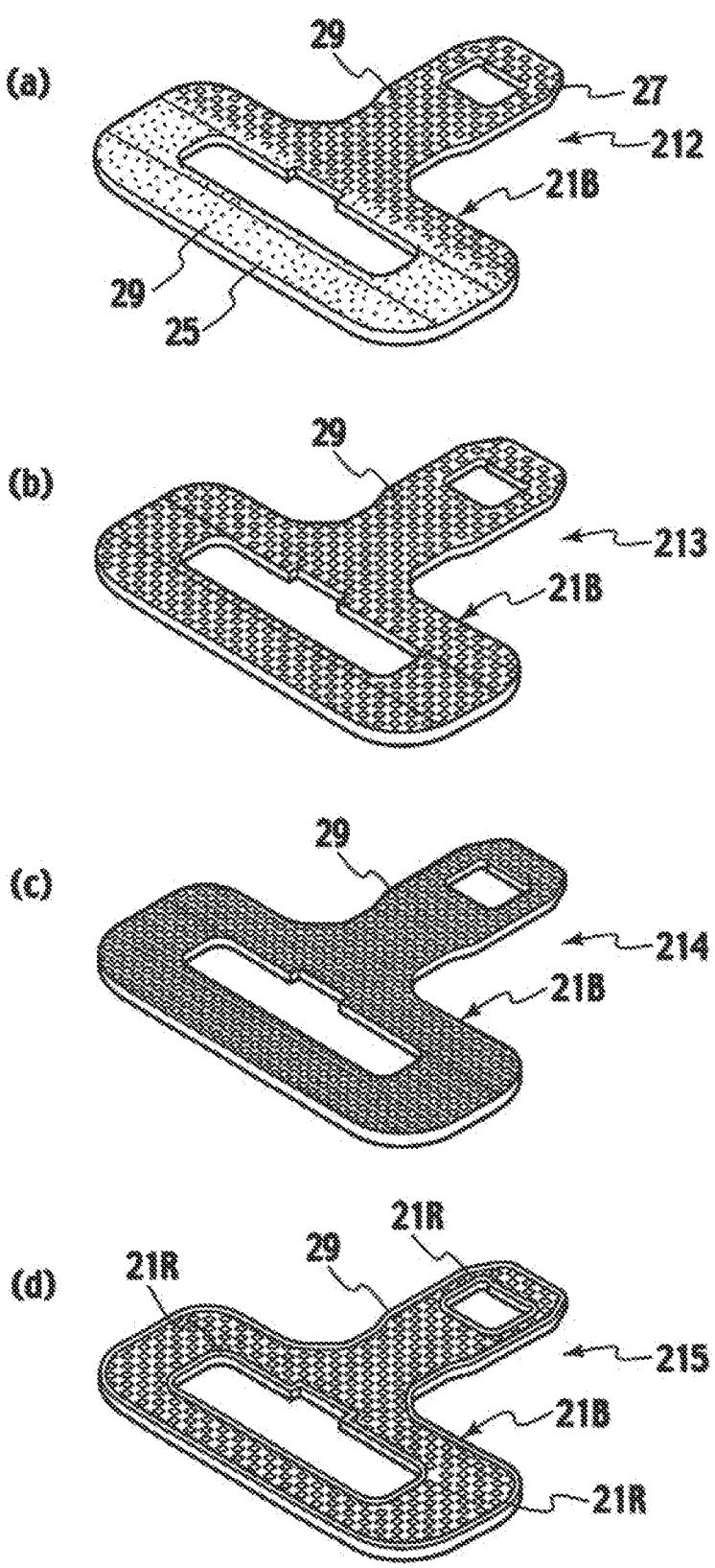
FIGS. 10(*a*), 10(*b*), 10(*c*) and 10(*d*) are explanatory diagrams of concave and convex surfaces formed in tongue materials.

When the concave and convex surfaces are formed in both the front and rear surfaces of the tongue material 21B, the density of the convex parts or the concave parts in a portion of the tongue main body 25 which is covered with the molded resin 31 may be higher (larger) than the density of the convex parts or the concave parts in the insertion part 27 by making each convex part or concave part in the portion of the tongue main body 25 which is covered with the molded resin 31 smaller in size than each convex part or concave part in the insertion part 27, as in the case of a tongue 212 according to another embodiment which is shown in FIG. 10(*a*). The surface area can be increased by increasing the density in this manner. This increase makes it possible to enhance the performance of intimate contact with the molded resin 31.

Furthermore, each concave and convex surface may be formed with a structure in which convex parts or/and concave parts are almost evenly distributed throughout each surface of the tongue material 21B, as in the case of a tongue 213 according to yet another embodiment which is shown in FIG. 10(*b*). Moreover, streak-shaped convex parts 29 or streak-shaped concave parts may be formed into the shape of a lattice throughout each surface of the tongue material 21B, as in the case of a tongue 214 according to still another embodiment which is shown in FIG. 10(*c*). In this case, the structure of the tongue is not limited to a structure in which the streak-shaped convex parts 29 or the streak-shaped concave parts orthogonally cross with one another, and may be a structure in which the streak-shaped convex parts 29 or the streak-shaped concave parts cross with one another obliquely at any angle depending on the necessity. In addition, neither the shape of the streak-shaped convex parts 29 nor the streak-shaped concave parts is limited to a straight line. The streak-shaped convex parts 29 or the streak-shaped concave parts may be shaped like a curve, for instance, like an arc, a waveform or the like, depending on the necessity. Further, continuous or intermittent ribs 21R may be respectively provided to the outer periphery of the tongue material 21B and the outline portion of each hole in the structure of FIG. 10(*b*), as in the case of a tongue 215 according to another embodiment which is shown in FIG. 10(*d*).

Figure 11:
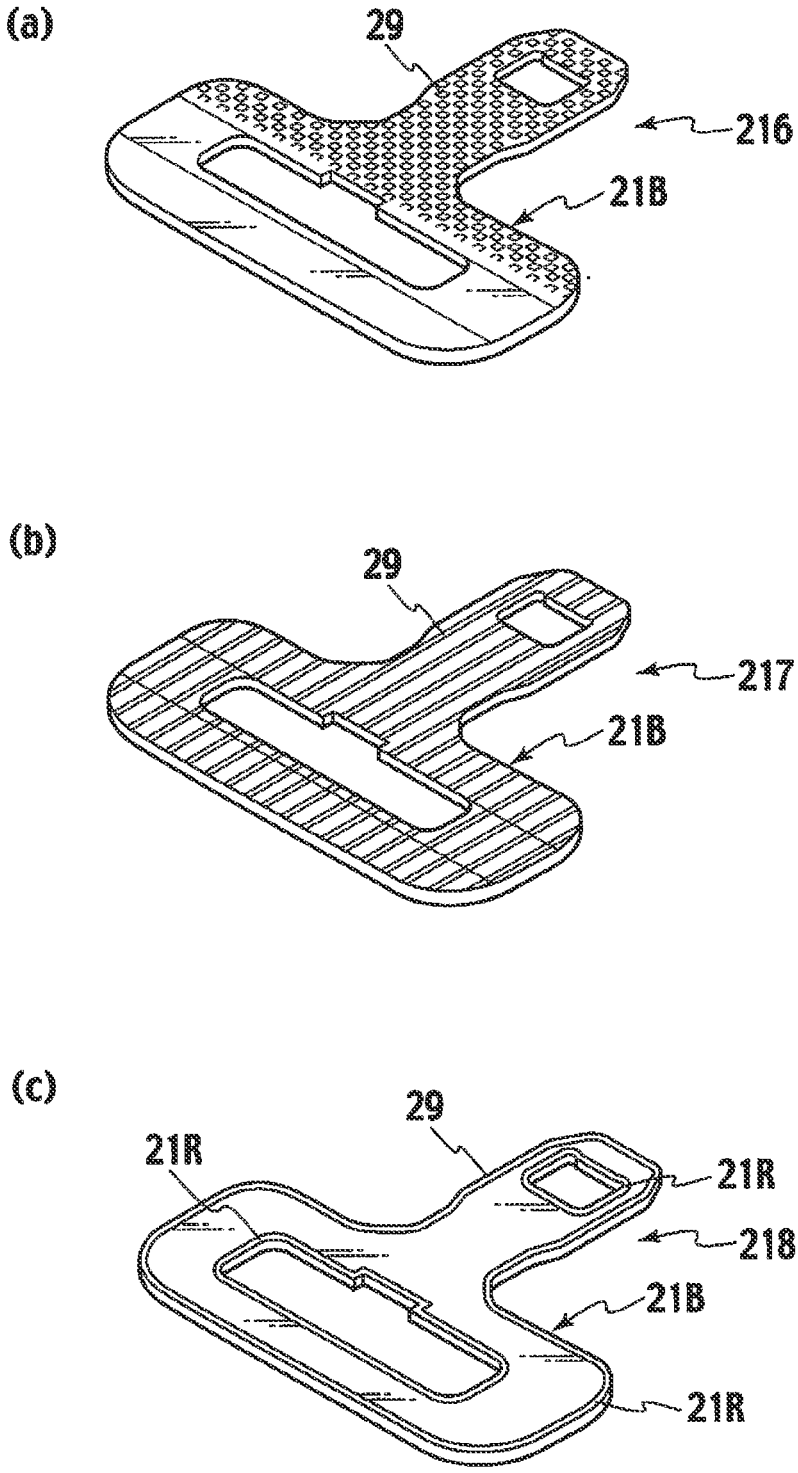
FIGS. 11(*a*), 11(*b*) and 11(*c*) are explanatory diagrams of other concave and convex surfaces formed in tongue materials.

Still furthermore, the tongue material 21B may be made with a structure in which a concave and convex surface including convex parts 29 or concave parts is formed, except for its portion covered with the molded resin 31, namely in its portion which is not covered with the molded resin 31, as in the case of a tongue 216 according to another embodiment which is shown in FIG. 11(*a*). Conversely, a concave and convex surface including convex parts or concave parts may be formed only in the portion which is covered with the molded resin 31.

Yet still furthermore, as a modification of the tongue shown in FIG. 10(*c*), each surface of the tongue material 21B may be made with a structure in which streak-shaped convex parts 29 are formed in a way to extend in the same directions as the insertion part 27 protrudes, as in the case of a tongue 217 according to another embodiment which is shown in FIG. 11(*b*). In this structure, the directions in which the streak-shaped convex parts 29 extend is identical to the directions in which the insertion part 27 is inserted in and detached from the buckle in the seat belt system. For this reason, this structure makes it possible to prevent scratches from being caused in each plane part when the insertion part 27 is inserted in or detached from the buckle.

FIG. 11(*c*) shows a modification of the tongue shown in FIG. 10(*d*). The modification is a tongue 218 in which only the ribs 21R are left whereas all the convex parts 29 are eliminated. This structure also inhibits tongue materials 21 from making a surface contact with one another. For this reason, this structure can bring about the same effect which has been described above.

In short, as understood through the foregoing descriptions, the embodiments make it possible to enhance the aesthetic appearance quality of the insertion part 27 in the tongue 21, and accordingly to solve the conventional problem described above.

The present invention is not limited to what has been described with regard to the foregoing embodiments of the present invention. In addition to the above-described mode, the present invention can be carried out as other various modes by modifying the present invention depending on the necessity.

Note that all the contents of Japanese Patent Application No. 2007-167431 (filed on Jun. 26, 2007) are incorporated herein by reference.

The invention claimed is:

1. A tongue used in a seat belt system, comprising:

a tongue main body including a belt insertion hole in which to insert a seat belt;

an insertion part being capable of being inserted in a buckle in the seat belt system, including a lock hole to which a lock piece included in the buckle is capable of being locked, the insertion part projecting from the tongue main body; and a plurality of convex parts being formed on a front surface of the insertion part so as to remain a plane part between the plurality of convex parts on the front surface of the insertion part.

2. The tongue according to claim 1, wherein the convex parts included in a rear surface of the tongue are formed corresponding to the plane part included in the front surface.

3. The tongue according to claim 1, wherein a height of each convex part from the plane part is 0.01 mm to 0.10 mm.

4. A tongue used in a seat belt system, comprising:

a tongue main body including a belt insertion hole in which to insert a seat belt;

an insertion part being capable of being inserted in a buckle in the seat belt system, including a lock hole to which a lock piece included in the buckle is capable of being locked, and projecting from the tongue main body; and a plurality of convex parts being formed on a front surface of the tongue main body so as to remain a plane part between the plurality of convex parts on the front surface of the tongue main body.

5. The tongue according to claim 4, wherein the convex parts included in a rear surface of the tongue are formed corresponding to the plane part included in the front surface.

6. The tongue according to claim 4, wherein a height of each convex part from a reference position or a depth of each concave part from the reference position is 0.01 mm to 0.10 mm.

7. A tongue used in a seat belt system, comprising:

a tongue main body including a belt insertion hole in which to insert a seat belt;

an insertion part being capable of being inserted in a buckle in the seat belt system, including a lock hole to which a lock piece included in the buckle is capable of being locked, and projecting from the tongue main body; and a plurality of convex parts being formed on a front surface of the insertion part and a front surface of the tongue main body, so as to remain a plane part between the plurality of convex parts on the front surface of the insertion part and the tongue main body.

8. The tongue according to claim 7, wherein the convex parts included in a rear surface of the tongue are formed corresponding to the plane part included in the front surface.

9. The tongue according to claim 7, wherein a height of each convex part from the plane part is 0.01 mm to 0.10 mm.

* * * * *